US005263307A

United States Patent [19]

Hasui

[11] Patent Number: 5,263,307

[45] Date of Patent: Nov. 23, 1993

[54] CORROSION RESISTANT PC STEEL STRANDED CABLE AND PROCESS OF AND APPARATUS FOR PRODUCING THE SAME

[75] Inventor: Takeshi Hasui, Asahigawa, Japan

[73] Assignee: Hokkai Koki Co., Ltd., Hokkaido, Japan

[21] Appl. No.: 908,883

[22] Filed: Jul. 7, 1992

Related U.S. Application Data

[63] Continuation of Ser. No. 655,587, Feb. 15, 1991, abandoned.

[51] Int. Cl.[5] ..... D02G 3/36; D07B 1/06

[52] U.S. Cl. ..... 57/221; 57/1 UN; 57/7; 57/296; 57/297

[58] Field of Search ..... 57/1 UN, 6, 7, 295, 57/296, 297, 314, 221, 223

[56] References Cited

U.S. PATENT DOCUMENTS

| | | | |
|---|---|---|---|
| 2,067,405 | 1/1937 | Mayne | 57/7 |
| 3,646,748 | 3/1972 | Lang | 57/7 X |
| 3,922,437 | 11/1975 | Kitta et al. | 57/223 X |
| 3,972,304 | 8/1976 | Boucher | 57/296 X |
| 3,988,884 | 11/1976 | Kikugawa | 57/7 |
| 4,154,892 | 5/1979 | Glatti et al. | 174/110.4 X |
| 4,192,057 | 3/1980 | Borelly | 57/7 X |
| 4,205,515 | 6/1980 | Garner | 57/1 UN |
| 4,252,583 | 2/1981 | Garner | 57/1 UN |
| 4,269,023 | 5/1981 | Garner | 57/314 X |
| 4,445,321 | 5/1984 | Hutchinson | 57/7 X |
| 4,533,401 | 8/1985 | Yutori et al. | 148/12.4 X |
| 4,547,228 | 10/1985 | Girrell et al. | 148/20.3 X |
| 4,816,090 | 3/1989 | Doonan et al. | 148/337 X |

FOREIGN PATENT DOCUMENTS

| | | | |
|---|---|---|---|
| 53-47609 | 12/1978 | Japan . | |
| 59-130960 | 7/1984 | Japan . | |
| 61-144121 | 9/1986 | Japan . | |
| 2-242989 | 9/1990 | Japan | 57/314 |

*Primary Examiner*—Daniel P. Stodola
*Assistant Examiner*—William Stryjewski
*Attorney, Agent, or Firm*—Sughrue, Mion, Zinn, Macpeak & Seas

[57] ABSTRACT

A corrosion resistant PC steel stranded cable for a pretensioning method has a core wire and a plurality of side which are coated firmly for the corrosion proof with paint of a synthetic resin material while maintaining a stabilized stranded condition. The cable comprises the single core wire and the plurality of side wires disposed in a closely contacting relationship with each other and also with the core wire in such a manner as to define a plurality of spiral air gaps between the core wire and the side wires and also to define a plurality of spiral recessed grooves between individual adjacent ones of the side wires on the outer side of the side wires. Each of the core wire and the side wires are processed by blueing in advance. Paint of a synthetic resin material is filled in the spiral air gaps, and a coating layer of paint of a synthetic resin material is formed substantially with a uniform thickness on an entire outer periphery of the side wires including the spiral recessed grooves. A process of and an apparatus for producing such corrosion resistant PC steel stranded cable are also provided.

9 Claims, 6 Drawing Sheets

CORROSION RESISTANT PC STEEL STRANDED CABLE AND PROCESS OF AND APPARATUS FOR PRODUCING THE SAME

This is a continuation of application Ser. No. 07/655,587 filed Feb. 15, 1991, now abandoned.

BACKGROUND OF THE INVENTION

1. Field of the Invention

This invention relates to a corrosion resistant PC steel stranded cable for use with a prestressed concrete structure and also to a process of and an apparatus for producing such corrosion resistant PC steel stranded cable.

2. Description of the Prior Art

Conventionally, a high strength steel stranded cable is widely used as a PC steel element for applying prestress to concrete of a prestressed concrete structure in a pretensioning method or a posttensioning method.

A corrosion resistant PC steel stranded cable is already disclosed, for example, in Japanese Patent Laid-Open No. 130960/1984, Japanese Patent Publication No. 47609/1978 or Japanese Utility Model Laid-Open No. 144121/1986 which is obtained by applying suitable corrosion resisting processing to a high strength steel stranded cable.

Referring to FIG. 17, there is shown a corrosion resistant PC steel stranded cable which is disclosed in Japanese Patent Laid-Open No. 130960/1984. The corrosion resistance PC steel stranded cable 10F shown includes a bare PC steel stranded cable 10 composed of a plurality of side wires 10*a* and a core wire 10*b*, and a coating layer 11 of paint of a synthetic resin material such as an epoxy resin coated on an entire outer periphery of the bare PC steel stranded cable 10.

In the corrosion resistant PC steel stranded cable 10F, a plurality of spiral air gaps 12 are defined between the side wires 10*a* and the core wire 10*b* and extend along a longitudinal direction of the corrosion resistant PC steel stranded cable 10F while a spiral recessed groove 13 is defined on the outside of and between each adjacent ones of the side wires 10*a* within the coating layer 11 and extends in the longitudinal direction of the corrosion resistant PC steel stranded cable 10F. In order to fill up such spiral recessed grooves 13 completely, it is necessary to partially increase the thickness of the synthetic resin paint coating layer 11, and if the synthetic resin paint coating layer 11 is so formed, then the thickness of a plurality of spiral recessed grooves 14 which are formed on an outer face of the synthetic resin paint coating layer 11 and extend in a longitudinal direction of the coating layer 11 will be decreased as much. In other words, the size of the spiral recessed grooves 14 is decreased.

Such corrosion resistant PC steel stranded cable 10F is adopted in a pretensioning method and imparts tensile force applied in advance thereto to concrete due to sticking thereof to the concrete. However, the corrosion resistant PC steel stranded cable 10F is disadvantageous in that such sticking force decreases as the size of the spiral recessed grooves 14 decreases and consequently introduction of prestress thereof into the concrete becomes insufficient.

Further, since the PC steel stranded cable 10F has the spiral air gaps 12 therein, if the opposite longitudinal end faces are not enclosed perfectly, air or water may be admitted into and flow in the air gaps 12 and cause corrosion of the wires 10*a* and 10*b*.

In addition, if the synthetic resin paint coating layer 11 should have a pin hole or should be damaged upon placing of concrete, then air or water may be admitted into the spiral air gaps 12 through the pin hole or damage of the synthetic resin paint coating layer 11 and may cause internal corrosion of the PC steel stranded cable 10F.

FIG. 18 shows a corrosion resistant PC steel stranded cable disclosed in Japanese Patent Publication No. 47609/1978. Referring to FIG. 18, the corrosion resistance PC steel stranded cable 10G shown includes a bare PC steel stranded cable 10 having a similar construction to that of the bare PC steel stranded cable 10 shown in FIG. 17. Lubricant 15 of the oil type which serves also as an anticorrosive is applied to a surface of the bare PC steel stranded cable 10, and a coating tube 16 of paint of a synthetic resin material is fitted around the bare PC steel stranded cable 10.

The corrosion resistant PC steel stranded cable 10G is adopted in a posttensioning method and, after concrete is hardened, the corrosion resistant PC steel stranded cable 10G is strained and fixed to the concrete to provide prestress to the concrete. When such prestress is to be introduced, the sticking force to the concrete need not be called in question, but on the contrary the bare PC steel stranded cable 10 must necessarily be moved in its longitudinal direction with respect to the concrete.

The corrosion resistant PC steel stranded cable 10G is disadvantageous in that the lubricant 15 is deteriorated as time passes or the applied condition of the lubricant 15 likely becomes imperfect. It is another disadvantage that, if the synthetic resin paint coating tube 16 is damaged by some causes upon placing of concrete or the like, then the corrosion resisting property is deteriorated extremely.

A corrosion resistant PC steel stranded cable which eliminates such drawbacks of the corrosion resistant PC steel stranded cable 10G has been proposed and is shown in FIG. 21. Referring to FIG. 21, the improved corrosion resistant PC steel stranded cable 10J shown is similar in construction to the corrosion resistant PC steel stranded cable 10F shown in FIG. 17 in that an entire outer periphery of a bare PC steel stranded cable 10 is covered with a coating layer 17 of paint of a synthetic resin material such as an epoxy resin and a coating tube 18 of paint of a synthetic resin material is fitted around the synthetic resin paint coating layer 17 on the corrosion resistant PC steel stranded cable 10F by protrusion molding.

However, the improved corrosion resistant PC steel stranded cable 10J is still disadvantageous in that, since a plurality of spiral air gaps 12 are formed between a plurality of side wires 10*a* and a core wire 10*b* similarly as in the corrosion resistant PC steel stranded cable 10F of FIG. 17, air or water is likely admitted into the spiral air gaps 12 by way of openings of the longitudinal opposite end faces of the corrosion resistant PC steel stranded cable 10J or a pin hole or a damaged portion of the synthetic resin paint coating layer 17.

Meanwhile, Japanese Utility Model Laid-Open No. 114121/1986 discloses two different corrosion resistant PC steel stranded cables. One of the two corrosion resistant PC steel stranded cables is shown in FIG. 19. Referring to FIG. 19, the corrosion resistant PC steel stranded cable 10H shown includes a coated PC steel stranded cable 10' composed of a plurality of side wires 10*a* and a core wire 10*b* which are each coated with a coating layer 22 of paint of a synthetic resin material and are stranded with one another. Lubricant 19 is applied to a surface of the coated PC steel stranded cable 10', and a coating tube 20 of paint of a synthetic resin material is fitted around the coated PC steel stranded cable 10'.

FIG. 20 shows the other corrosion resistant PC steel stranded cable disclosed in Japanese Utility Model Laid-Open No. 114121/1986. Referring to FIG. 20, the corrosion resistant PC steel stranded cable 10I shown includes a coated PC steel stranded cable 10' of the similar construction to that of the corrosion resistant PC steel stranded cable 10H, and a coating layer 21 of paint of a synthetic resin material is provided directly around an outer periphery of the coated PC steel stranded cable 10' without applying lubricant to the coated PC steel stranded cable 10'.

The corrosion resistant PC steel stranded cables 10H and 10I shown in FIGS. 19 and 20 are superior in corrosion resisting property because the side wires **10*a* and the core wire 10*b* are individually covered with the separate synthetic resin paint coating layers 22**.

However, to this end, such synthetic resin paint coating layers 22 must naturally be formed in advance on the side wires **10*a* and the core wire 10*b* before they are stranded with each other. However, due to presence of the synthetic resin paint coating layers 22**, heat treatment necessary to remove residual stress after stranding operation, that is, blueing, cannot be performed.

Blueing is performed such that, after the stranding operation of the bare PC steel stranded cable 10, it is heated to about 400° C. to remove residual stress after working to stabilize the stranded condition of the bare PC steel stranded cable 10. If such blueing is not performed, then a problem will arise that, each time the bare PC steel stranded cable is cut into a segment of a required length, the strand or twist of the bare PC steel stranded cable will be loosened or cancelled from a thus cut end portion of the bare PC steel stranded cable.

Even if it is tried to conduct suitable working in order to maintain the strand or twist without performing blueing, this is accompanied by extreme difficulty, and besides, upon such working, there is the possibility that the synthetic resin paint coating layer 22 may be damaged. Thus, it is a disadvantage that an anticipated corrosion resisting effect cannot be maintained.

SUMMARY OF THE INVENTION

It is an object of the present invention to provide a corrosion resistant PC steel stranded cable for a pretensioning method wherein a core wire and a plurality of side wires are coated firmly for the corrosion resistance with paint of a synthetic resin material while maintaining a stabilized stranded condition.

It is another object of the present invention to provide a corrosion resistant PC steel stranded cable for a pretensioning method wherein a plurality of comparatively great spiral grooves are formed on an outer periphery thereof to present an anticipated sticking force to concrete to allow introduction of sufficient prestress to the concrete.

It is a further object of the present invention to provide a corrosion resistant PC steel stranded cable for a posttensioning method wherein a core wire and a plurality of side wires are coated firmly for the corrosion resistance with paint of a synthetic resin material while maintaining a stabilized stranded condition.

It is a still further object of the present invention to provide a process of and an apparatus for producing such a corrosion resistant PC steel stranded cable for a pretensioning method or a posttensioning method simply and with certainty without causing any damage particularly to a coating.

In order to attain the objects, according to one aspect of the present invention, there is provided a corrosion resistant PC steel stranded cable, which comprises a single core wire, a plurality of side wires disposed in a closely contacting relationship with each other and also with the core wire in such a manner as to define a plurality of spiral air gaps between the core wire and the side wires and also define a plurality of spiral recessed grooves between individual adjacent ones of the side wires on the outer side of the side wires, each of the core wire and the side wires being processed by blueing in advance, paint of a synthetic resin material filled in the spiral air gaps, and a coating layer of paint of a synthetic resin material formed substantially with a uniform thickness on an entire outer periphery of the side wires including the spiral recessed grooves. The corrosion resistant PC steel stranded cable is suitable for use in a pretensioning method.

The corrosion resistant PC steel stranded cable maintains a stabilized stranded or twisted condition while the side wires and the core wire are individually coated with the synthetic resin paint because each of them is processed by blueing in advance. Further, the corrosion resistant PC steel stranded cable is very high in corrosion resisting effect because the side wires and the core wire are all covered with the synthetic resin paint. Besides, since the spiral recessed grooves on the outer periphery of the side wires are comparatively great, the corrosion resistant PC steel stranded cable exhibits a high sticking force to concrete, and sufficient prestress can be introduced to concrete.

An outer periphery of the synthetic resin paint coating layer may further be coated with another coating layer of paint of a synthetic resin material formed in a closely contacting relationship thereon in order to improve the corrosion resisting property and the strength of the corrosion resistant PC steel stranded cable.

A fatty substance may be applied to an outer periphery of the synthetic resin paint coating layer and another synthetic resin paint coating layer is fitted around the fatty substance to coat the latter. The corrosion resistant PC steel stranded cable is suitable for use in a posttensioning method. With the corrosion resistant PC steel stranded cable, the corrosion resisting effect is improved significantly since the additional synthetic resin paint coating layer is fitted around the first-mentioned synthetic resin paint coating layer.

According to another aspect of the present invention, there is provided a corrosion resistant PC steel stranded cable, which comprises a core wire, a plurality of side wires, each of the core wire and the side wires being processed by blueing in advance, and a coating layer of paint of a synthetic resin formed on an entire outer periphery of each of the core wire and the side wires, the side wires being disposed in a closely contacting relationship with each other and also with the core wire by way of the synthetic resin paint coating layers thereon in such a manner as to define a plurality of spiral air gaps between the synthetic resin paint coating layers on the core wire and the side wires and also define a plurality of spiral recessed grooves between the synthetic resin paint coating layers on individual adjacent ones of the side wires on the outer side of the side wires. The corrosion resistant PC steel stranded cable is suitable for use in a pretensioning method.

With the corrosion resistant PC steel stranded cable, similar effects to those described above are exhibited.

A fatty substance may be applied to outer peripheries of the synthetic resin paint coating layers on the side wires, and a coating tube of paint of a synthetic resin material is fitted around the fatty substance to coat the latter. The corrosion resistant PC steel stranded cable is suitable for use in a posttensioning method. With the corrosion resistant PC steel stranded cable, similarly the corrosion resisting effect is improved significantly.

According to a further aspect of the present invention, there is provided a process of producing a corrosion resistant PC steel strand cable from a bare PC steel stranded cable consisting of a core wire and a plurality of side wires disposed in a closely contacting relationship with each other and also with the core wire, each of the core wire and the side wires being processed by blueing in advance, the process comprising the steps of continuously untwisting the bare PC steel stranded cable over a predetermined length, applying paint of a synthetic resin material to the core wire and the side wires of the untwisted portion of the bare PC steel stranded cable to coat the core wire and the side wires individually with coatings of the synthetic resin paint, and twisting the side wires around the core wire of the untwisted portion of the bare PC steel stranded cable again.

The synthetic resin paint for coating the side wires and the core wire may be filled, at the twisting step, as synthetic resin paint in a plurality of spiral air gaps defined between the core wire and the side wires and also be coated as a synthetic resin paint coating layer of a substantially uniform thickness on an entire outer periphery of the stranded cables including a plurality of spiral recessed grooves formed between individual adjacent ones of the stranded cables outside the stranded cables.

Alternatively, the synthetic resin paint for coating the side wires and the core wire may be formed, at the twisting step, as synthetic resin paint coating layers individually for the side wires and the core wire so as to define a plurality of spiral air gaps between the core wire and the side wires and also define a plurality of spiral recessed grooves between individual adjacent ones of the stranded cables outside the stranded cables.

Otherwise, the producing process may further comprise the step of coating, after the twisting step, another coating layer of paint of a synthetic resin material in a closely contacting relationship on an outer periphery of the synthetic resin paint coating layer on the side wires.

Or else, the producing process may further comprise the steps of applying, after the twisting step, a fatty substance to an outer periphery of the synthetic resin paint coating layer or layers on the side wires and fitting a coating tube of paint of a synthetic resin around the fatty substance by extrusion molding to coat the fatty substance with the coating tube.

According to a still further aspect of the present invention, there is provided an apparatus for producing a corrosion resisting PC steel stranded cable, which comprises a supplying device for supplying therefrom a bare PC steel stranded cable which consists of a core wire and a plurality of side wires disposed in a closely contacting relationship with each other and also with the core wire, each of the core wire and the side wires being processed by blueing in advance, an untwisting device for continuously untwisting, over a predetermined length, the bare PC steel stranded cable supplied from the supplying device, a powder paint applying device for applying paint of a synthetic resin material to the core wire and the side wires of the untwisted portion of the predetermined length of the bare PC steel stranded cable to coat the core wire and the side wires with the synthetic resin paint to obtain a corrosion resisting PC steel stranded cable, the corrosion resisting PC steel stranded cable automatically restoring the twisted condition of the bare PC steel stranded cable after being fed out from the powder paint applying device, and a takeup device for winding the corrosion resistant PC steel stranded cable thereon.

The producing apparatus may further comprise a second powder paint applying device interposed between the first-mentioned powder paint applying device and the takeup device for applying paint of a synthetic resin paint of the corrosion resisting PC steel stranded cable after the corrosion resisting PC steel stranded cable is twisted again.

Alternatively, the producing apparatus may further comprise a fatty substance applying device for applying a fatty substance to an outer periphery of the corrosion resisting PC steel stranded cable after the corrosion resisting PC steel stranded cable is twisted again, and a protrusion molding machine for fitting a coating tube of paint of a synthetic resin material around an outer periphery of the fatty substance applied to the corrosion resisting PC steel stranded cable so as to coat the corrosion resisting PC steel stranded cable.

With the process and apparatus of the present invention, a corrosion resistant PC steel stranded cable according to the present invention can be produced readily with certainty.

The above and other objects, features and advantages of the present invention will become apparent from the following description and the appended claims, taken in conjunction with the accompanying drawings.

DESCRIPTION OF THE PREFERRED EMBODIMENTS

Figure 1:
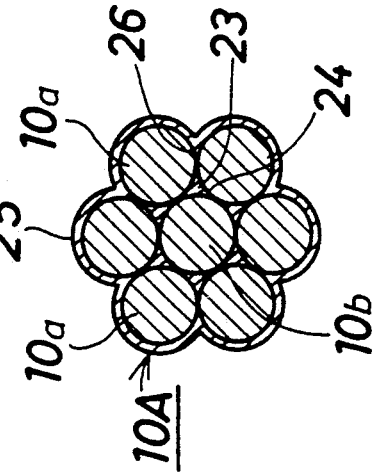
FIG. 1 is a cross sectional view of a corrosion resistant PC steel strand cable to which the present invention is applied.

Referring first to FIG. 1. there is shown a corrosion resistant PC steel stranded cable to which the present invention is applied. The corrosion resistant PC steel stranded cable 10A shown includes a plurality of, six in FIG. 1, side wires 10*a* and a single core wire 10*b*. The side wires 10*a* are disposed in a closely contacting relationship with each other and also with an outer periphery of the core wire 10*b*.

Paint 23 of a synthetic resin material such as polyethylene or an epoxy resin is filled up in a plurality of spiral gaps 24 defined between the core wire 10*b* and the side wires 10*a* and extending in a longitudinal direction of the corrosion resistant PC steel stranded cable 10A. Meanwhile, a coating layer 25 similarly made of a synthetic resin material such as polyethylene or an epoxy resin is coated on an entire outer periphery, that is, externally exposed faces of the strand wires 10*a* including externally directed spiral recessed grooves 26 which are formed individual mutually adjacent ones of the side wires 10*a* and extend in the longitudinal direction thereof.

Predetermined blueing is performed for the side wires 10*b* and the core wire 10*b* of the corrosion resistant PC steel stranded cable 10A before the synthetic resin paint 23 is filled up in the spiral air gaps 24 and the synthetic resin paint coating layer 25 is formed on the entire outer periphery of the corrosion resistant PC steel stranded cable 10A including the spiral recessed grooves 26.

With the corrosion resistant PC steel stranded cable 10A, since the predetermined blueing is performed as described above, a stabilized stranded condition is maintained.

Further, all of the side wires 10*a* and the core wire 10*b* are covered over the entire faces thereof with the synthetic resin material, and accordingly, the corrosion resistant PC steel stranded cable 10A has a sufficiently high corrosion resisting property.

In addition, since the spiral recessed grooves 26 of the outer periphery of the corrosion resistant PC steel stranded cable 10A are comparatively great in size and consequently the sticking force thereof to concrete is great, introduction of sufficient prestress to concrete can be achieved.

Figure 2:
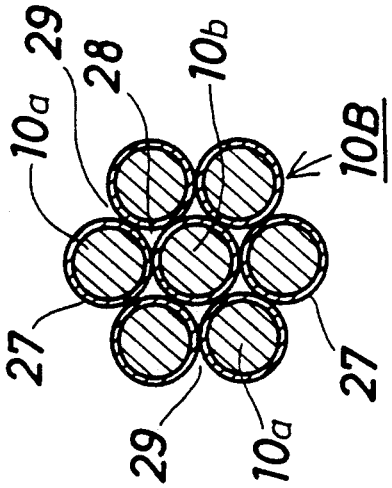
FIG. 2 is a cross sectional view of another corrosion resistant PC steel strand cable to which the present invention is applied.

Referring now to FIG. 2, there is shown another corrosion resistant PC steel stranded cable to which the present invention is applied. The corrosion resistant PC steel stranded cable 10B shown includes a plurality of side wires 10*a* and a single core wire 10*b*. Each of the side wires 10*a* and the core wire 10*b* is coated with an independent coating layer 27 of paint of a synthetic resin material such as polyethylene or an epoxy resin.

The side wires 10*a* are disposed in a closely contacting relationship with each other and also with an outer periphery of the single core wire 10*b* by way of the individual synthetic resin paint coating layers 27 thereof.

A plurality of spiral air gaps 28 are formed between the core wire 10*b* and the side wires 10*a*, or more accurately, between the synthetic resin paint coating layers 27 on the core wire 10*b* and the side wires 10*a* and extend in a longitudinal direction of the corrosion resistant PC steel stranded cable 10B. Meanwhile, a plurality of outwardly directed spiral recessed grooves 29 are formed between individual adjacent ones of the stranded cables 10*a*, or more accurately, between the synthetic resin paint coating layers 27 on individual adjacent ones of the stranded cables 10*a* and extend in the longitudinal direction of the corrosion resistant PC steel stranded cable 10B.

Predetermined blueing is performed for the side wires 10*a* and the core wire 10*b* of the corrosion resistant PC steel stranded cable 10B before the synthetic resin paint coating layers 27 are formed on them.

The corrosion resistant PC steel stranded cable 10B is different from the corrosion resistant PC steel stranded cable 10A shown in FIG. 1 in that it has the spiral air gaps 28 in the inside thereof and the side wires 10*a* are not directly contacted with the core wire 10*b*, that is, the side wires 10*a* and the core wire 10*b* are held in a closely contacting relationship with each other by way of the synthetic resin paint coating layers 27 individually coated on the side wires 10*a* and the core wire 10*b*.

However, the corrosion resistant PC steel stranded cable 10B is advantageous, similarly to the corrosion resistant PC steel stranded cable 10A shown in FIG. 1, in that, since predetermined blueing is performed, a stabilized stranded condition is maintained, and since the side wires 10*a* and the core wire 10*b* are all coated over the entire outer peripheries thereof with the synthetic resin paint, it exhibits a sufficiently high corrosion resisting property, and besides since the comparatively great spiral recessed grooves 29 are formed on the outer periphery of the corrosion resistant PC steel stranded cable 10B, the sticking force to concrete is great.

It is to be specifically noted that, since the corrosion resistant PC steel stranded cable 10B has the spiral air gaps 28 in the inside thereof, it is superior in flexibility to the corrosion resistant PC steel stranded cable 10A shown in FIG. 1, and accordingly, it is improved in operability as much.

Subsequently, a process of and an apparatus for producing such corrosion resistant PC steel stranded cable 10A or 10B according to the present invention will be described with reference to FIGS. 3 to 11.

Figure 3:
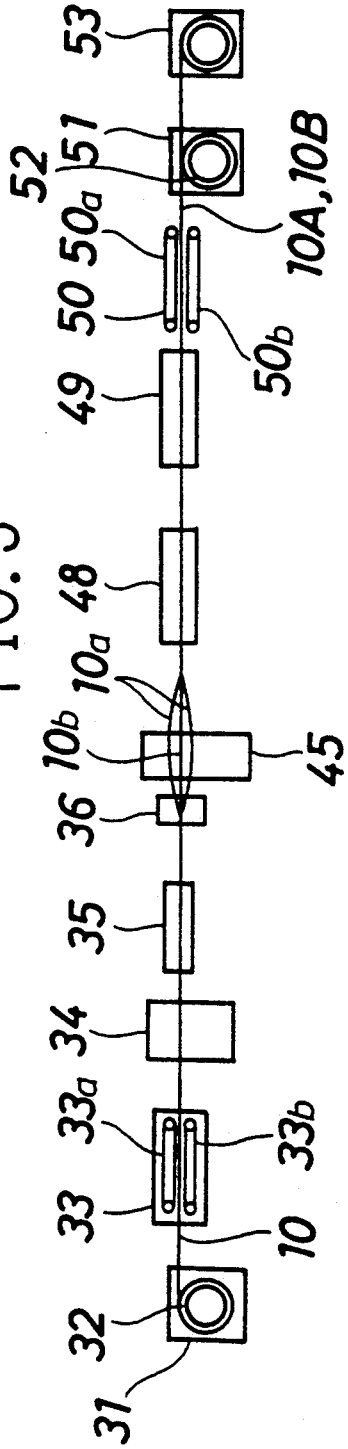
FIG. 3 is a schematic view showing construction of an apparatus for producing a corrosion resistant PC steel strand to which the present invention is applied.
Figure 10:
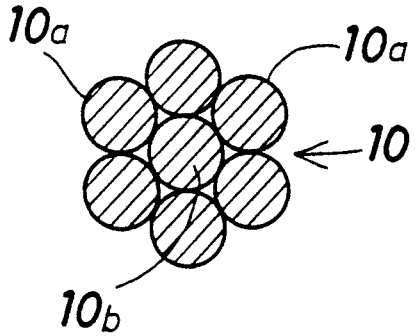
FIG. 10 is a cross sectional view of a bare PC steel stranded cable.

Referring first to FIG. 3, there is shown general construction of an apparatus for producing a corrosion resistant PC steel stranded cable. The apparatus shown includes a supplying device 31 for supporting a bobbin 32 for rotation thereon and supplying a bare PC steel stranded cable 10 from the bobbin 32 thereof. The bare PC steel stranded cable 10 is wound in advance around the bobbin 32 and is composed of, as shown in FIG. 10, a single core wire 10*b* and a plurality of side wires 10*a* stranded around the core wire 10*b*.

The stranded cable producing apparatus further includes a feeding device 33 including a pair of driving endless belts 33*a* and 33*b* disposed in a mutually contacting relationship at upper and lower locations so that the bare PC steel stranded cable 10 drawn out from the supplying device 31 may be held therebetween and compulsorily fed into a sticking substance removing device 34.

The sticking substance removing device 34 may be a shot blast wherein very small steel balls or steel pieces or the like are blasted to a surface of the bore PC steel stranded cable 10 to remove sticking foreign substances such as oil from the bare PC steel stranded cable 10.

The bare PC steel stranded cable 10 is then fed into a front stage heating device 35 which may be a high frequency induction heating device and heats the bare PC steel stranded cable 10 to a temperature necessary for powder coating at a subsequent stage.

The bare PC steel stranded cable 10 is thereafter fed into an untwisting device 36 by which it is untwisted to separate the side wires 10*a* and the core wire 10*b* from one another.

Figure 4:
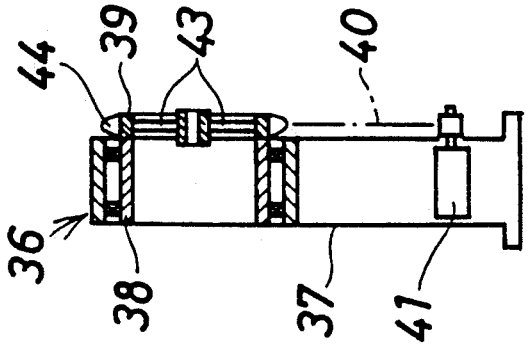
FIG. 4 is a sectional view of an untwisting device of the apparatus of FIG. 3.

Referring to FIG. 4, the untwisting device 36 includes a rotary tubular body 38 supported for rotation on a base 37 and an untwisting guide plate 39 mounted on the rotary tubular body 38. The untwisting guide plate 39 is rotated by a motor 41 by way of a chain 40.

Figure 5:
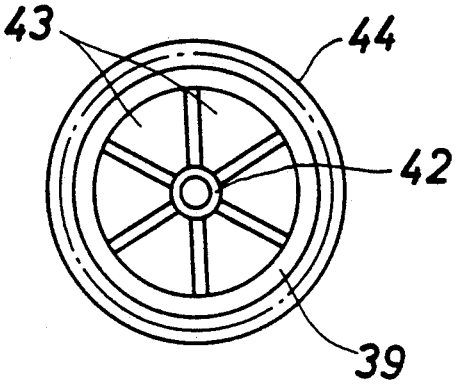
FIGS. 5 and 6 are a front elevational view and a sectional view, respectively, of an untwisting guide plate of the untwisting device of FIG. 4.
Figure 6:
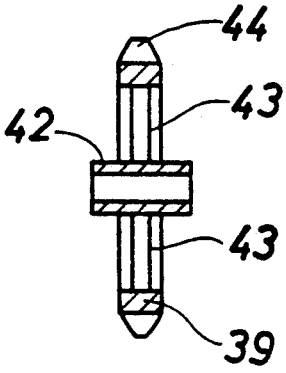

Referring to FIGS. 5 and 6, the untwisting guide plate 39 includes a core wire guide tube 42 and a chain wheel 44 extending circumferentially around the core wire guide tube 42 and connected to the core wire guide tube 42 by way of a plurality of stays or radial elements defining sectional side wire guide holes 43 between them.

Figure 7:
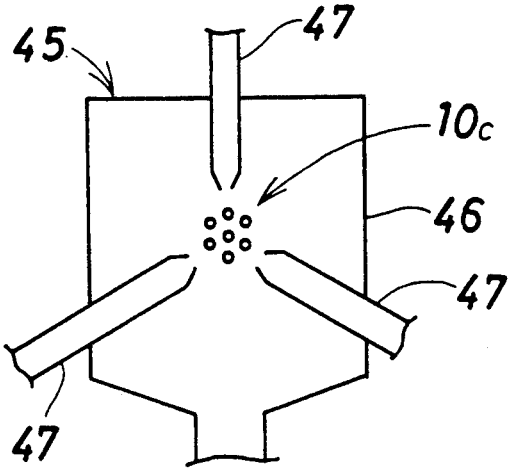
FIG. 7 is a schematic partial sectional view of a powder paint applying device of the apparatus of FIG. 3.
Figure 8:
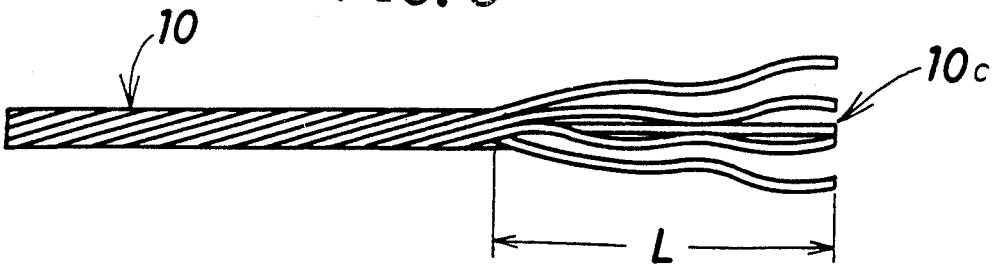
FIG. 8 is a side elevational view showing an end portion of a bare PC steel stranded cable in an untwisted condition.

Referring back to FIG. 3, the bare PC steel stranded cable 10 is subsequently fed into a powder paint applying device 45. Referring now to FIG. 7, the powder paint applying device 45 includes a spray booth 46 into which an untwisted portion 10*c* of the bare PC steel stranded cable 10 is introduced, and three spray guns 47 which spray powder paint of a synthetic resin material in three directions toward the untwisted portion 10*c* of the bare PC steel stranded cable 10 together with air.

Referring back again to FIG. 3, the bare PC steel stranded cable 10 is subsequently fed into a rear stage heating device 48 for which an infrared lamp may be employed, and then into a water or air cooling device 49 in which the bare PC steel stranded cable 10 to which synthetic resin powder paint has been applied is cooled to a normal room temperature.

The bare PC steel stranded cable 10 is then fed into a drawing out device 50 by which it is compulsorily drawn out forwardly. The drawing out device 50 includes a pair of driving endless belts 50*a* and 50*b* disposed in a mutually contacting relationship at upper and lower locations for holding therebetween and compulsorily drawing out forwardly the bare PC steel stranded cable 10 with synthetic resin powder paint applied thereto, that is, such a corrosion resistant PC steel stranded cable 10A or 10B as described hereinabove.

The bare PC steel stranded cable 10, that is, the corrosion resistant PC steel stranded cable 10A or 10B for which corrosion resisting processing has been completed, is fed into a takeup device 51 in which a bobbin 52 is driven to rotate so that the bare PC steel stranded cable 10 is wound onto the bobbin 52.

The stranded cable producing apparatus further includes a leading wire takeup device 53 for a preparatory operation.

Description will subsequently be given of a producing process of the present invention which is performed using the stranded cable producing apparatus described above.

First, a leading end of a bare PC steel stranded cable 10 is forwarded from the supplying device 31 and threaded between the endless belts 33*a* and 33*b* of the feeding device 33 and then through the sticking substance removing device 34 and the front stage heating device 35 into the untwisting device 36.

The bare PC steel stranded cable 10 is produced in a well known, popular method such that a plurality of side wires 10*a* are stranded around a single core wire 10*b* such that a spiral recessed groove 26 is formed between each adjacent ones of the side wires 10*a* and extends in a longitudinal direction of the bare PC stranded cable 10 and they are processed by predetermined blueing.

Before the bare PC steel stranded cable 10 is fed into the untwisting device 36, a leading end portion thereof is untwisted over a required length L to separate the side wires 10*a* and core wire 10*b* at the leading end portion from each other by manual operation, and the thus separated side wires 10*a* are threaded into the side wire guide holes 43 of the untwisting guide plate 39 while the core wire 10*b* is threaded into the core wire guide tube 42 of the untwisting guide plate 39.

Figure 9:
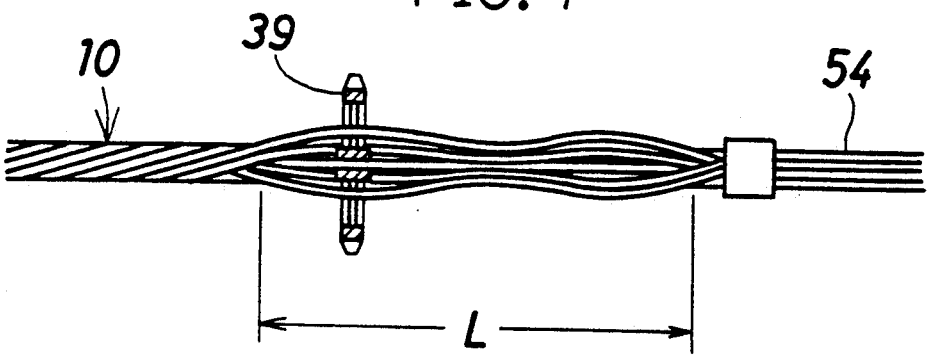
FIG. 9 is a side elevational view showing a retwisted portion at an end portion of a bare PC steel stranded cable which is fitted in the untwisting guide plate of FIGS. 5 and 6 and fixedly connected to a leading wire.

Thereafter, leading end portions of the side wires 10*a* at the untwisted portion of the bare PC steel stranded cable 10 are twisted or stranded again around the core wire 10*b* as shown in FIG. 9 by manual operation. Such stranding can be performed readily without much labor because each of the side wires 10*a* is in a permanently deformed or twisted condition.

Subsequently, a leading wire 54 is securely connected to the thus re-twisted end portion of the bare PC steel stranded cable 10 by suitable means as shown in FIG. 9. The leading wire 54 is threaded through the powder paint applying device 45, rear stage heating device 48, cooling device 59 and drawing out device 50 and wound around the leading wire takeup device 53.

Continuous operation of the producing apparatus will be started in this condition. Then, the bare PC steel stranded cable 10 is continuously supplied from the supplying device 31 into the feeding device 33 and then fed through the various devices described above so that predetermined corrosion resistant processing is applied thereto, whereafter it is drawn out by the drawing out device 50.

Then, after a portion of the bare PC steel stranded cable 10 to which corrosion resistant processing has been performed completely is drawn out to the outside of the drawn out device 50, a leading end portion of the bare PC steel stranded cable 10 to which corrosion resistant processing has not been performed completely is cut off and removed from the bare PC steel stranded cable 10, and a succeeding portion of the bare PC steel stranded cable 10 which is successively drawn out from the drawing out device 50, that is, the corrosion resistant PC steel stranded cable 10A or 10B, is wound onto the bobbin 52 of the takeup device 51.

Subsequently, the corrosion resistant processing step will be described in detail.

The bare PC steel stranded cable 10 is fed in its axial direction, that is, in its longitudinal direction while it is prevented from rotation around its axis by the feeding device 33 and the drawing out device 50.

At the front stage heating device 35, the bare PC steel stranded cable 10 is heated to such a degree that a required temperature is assured to melt synthetic resin powder paint when such synthetic resin powder paint is applied to the bare PC steel stranded cable 10 subsequently by the powder paint applying device 45.

The bare PC steel stranded cable 10 in a thus heated condition is subsequently fed into the untwisting device 36. In the untwisting device 36, the untwisting guide plate 39 is rotated in accordance with a strand pitch of the bare PC steel stranded cable 10 in a predetermined direction by the motor 41 so that the bare PC steel stranded cable 10 is untwisted always over a length equal to the length L over which a leading end portion thereof has been untwisted to separate the side wires 10*a* and core wire 10*b* thereof from each other upon initial threading thereof as described hereinabove. However, the thus untwisted portion of the bare PC steel stranded cable 10 is automatically twisted or stranded again after it is fed over the length L. The length L is set in advance to a value with which the untwisted condition of the bare PC steel stranded cable 10 is maintained for a required period of time after synthetic resin powder paint which will be described below is sprayed thereto.

Figure 11:
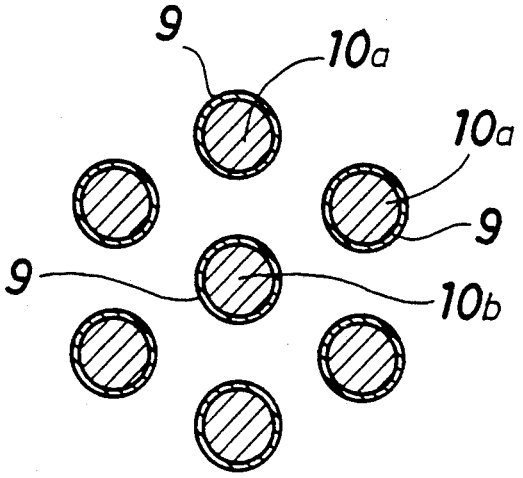
FIG. 11 is a cross sectional view of an untwisted portion of the bare PC steel stranded cable of FIG. 10 to which paint of a synthetic resin is applied.

The bare PC steel stranded cable 10 in the thus untwisted condition is subsequently fed into the spray booth 46 of the powder paint applying device 45, in which powder paint of a synthetic resin material such as polyethylene or an epoxy resin which is charged with a negative charge is sprayed toward the bare PC steel stranded cable 10 from the spray guns 47. The thus sprayed synthetic resin powder paint sticks to surfaces of the side wires 10*a* and core wire 10*b* of the bare PC steel stranded cable 10 to which negative charge has been applied at the untwisting device 36. The synthetic resin powder paint is then melted by the side wires 10*a* and core wire 10*b* of the bare PC steel stranded cable 10, thereby forming a synthetic resin paint coating 9 on each of the side wires 10*a* and core wire 10*b* as seen in FIG. 11.

As the bare PC steel stranded cable 10 is fed, the untwisted portion 10*c* thereof is brought into a twisted or stranded condition again while the synthetic resin forming the synthetic resin paint coating 9 remains in a molten condition, that is, before the synthetic resin becomes hardened. Consequently, the synthetic resin of the synthetic resin paint coating 9 is deformed so that it fills up the radial air gaps 24 between the side wires 10*a* and the core wire 10*b* as in the corrosion resistant PC steel stranded cable 10A shown in FIG. 1 while it also makes such a synthetic resin paint coating layer as the synthetic resin paint coating layer 25 shown in FIG. 1 which covers an entire outer periphery of the side wires 10*a* including the spiral recessed grooves 26 between the side wires 10*a*.

After then, the synthetic resin paint coating layer 25 is heated again in the rear stage heating device 48 to put a surface thereof in good order and is then cooled in the cooling device 49 together with the synthetic resin paint 23 so that it is hardened, thereby obtaining such corrosion resistant PC steel stranded cable 10A as shown in FIG. 1.

The corrosion resisting PC steel strand cable 10A is wound up onto the bobbin 52 of the takeup device 51 by way of the drawing out device 50.

In production of the corrosion resisting PC steel strand cable 10A described above, if the time until the untwisted portion 10*c* of the bare PC steel stranded cable 10 is brought into a twisted condition again by feeding of the bare PC steel stranded cable 10 after the synthetic resin paint coatings 9 are formed on the surfaces of the side wires 10*a* and the core wire 10*b* (refer to FIG. 11)is set to a comparatively great value, or if the required length L described above is set to a comparatively great value in advance, then such corrosion resisting PC steel stranded cable 10B as shown in FIG. 2 can be produced by forming the synthetic resin paint coatings 9 as synthetic resin paint coating layers 27 which are independent of each other for the side wires 10*a* and the core wire 10*b* as shown in FIG. 2 and then by causing the synthetic resin paint coating layers 27 to be hardened in the cooling device 49.

It is to be noted that the rear stage heating device 48 is not necessarily provided depending upon a type of the synthetic resin powder paint.

Further, while the producing process described above employs a powder coating method based on an electrostatic method wherein positive and negative charges are applied to the bare PC steel strand cable 10 and powder paint, respectively, to cause the powder paint to stick to the bare PC steel strand cable 10 due to electrostatic force, a powder coating method may alternatively be employed which depends upon a fluid dipping method wherein the bare PC steel strand cable 10 is heated in advance and fluid powder paint is baked so as to stick to the bare PC steel strand cable 10.

Figure 12:
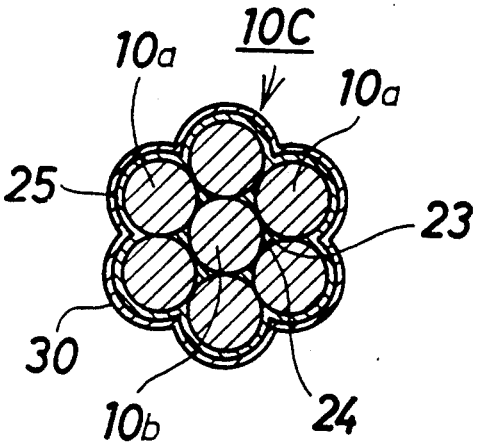
FIG. 12 is a cross sectional view of a further corrosion resistant PC steel stranded cable to which the present invention is applied.

Referring now to FIG. 12, there is shown a further corrosion resistant PC steel stranded cable to which the present invention is applied. The corrosion resistant PC steel stranded cable 10C shown is constructed as a corrosion resistant PC steel stranded cable for the pretensioning and corresponds to a modification to the corrosion resistant PC steel stranded cable 10A described hereinabove with reference to FIG. 1 in that another coating layer 30 of paint of a synthetic resin material such as polyethylene or an epoxy resin is formed in a closely contacting relationship on an outer periphery of the synthetic resin paint coating layer 25 which covers the entire outer periphery of the side wires 10*a* of the corrosion resistant PC steel stranded cable 10A.

Figure 13:
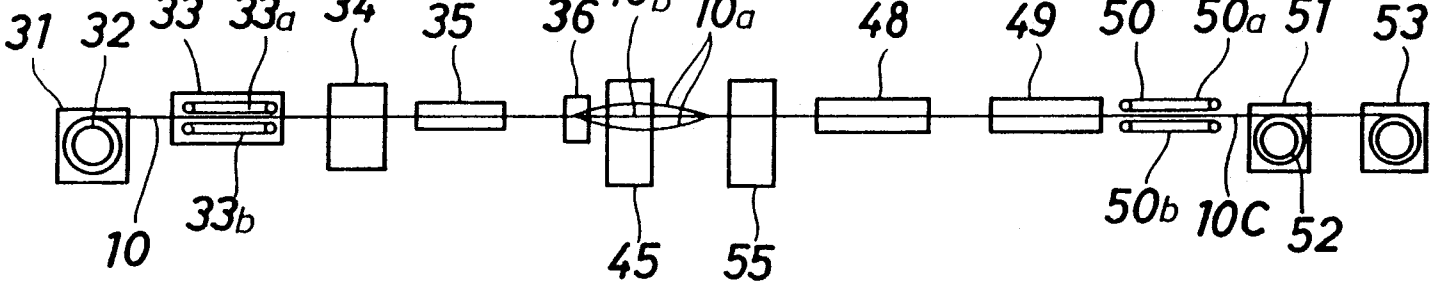
FIG. 13 is a schematic view showing construction of another apparatus for producing a corrosion resistant PC steel stranded cable to which the present invention is applied.

In order to produce the corrosion resistant PC steel stranded cable 10C, such a producing apparatus as shown in FIG. 13 is used. The producing apparatus shown in FIG. 13 corresponds to a modification to the producing apparatus shown in FIG. 3 in that another powder paint applying device 55 for a secondary coating is provided between the powder paint applying device 45 and the rear stage heating device 48.

Then, the corrosion resistant PC steel stranded cable 10C can be produced by forming, by the powder paint applying device 55, the synthetic resin paint coating layer 30 in a closely contacting relationship on an outer periphery of the synthetic resin paint coating layer 25 which is formed in a similar manner as in production of the corrosion resistant PC steel stranded cable 10A.

The corrosion resistant PC steel stranded cable 10C produced in this manner is apparently superior in corrosion resisting property, strength and so forth further to the corrosion resistant PC steel stranded cable 10A described hereinabove.

Figure 15:
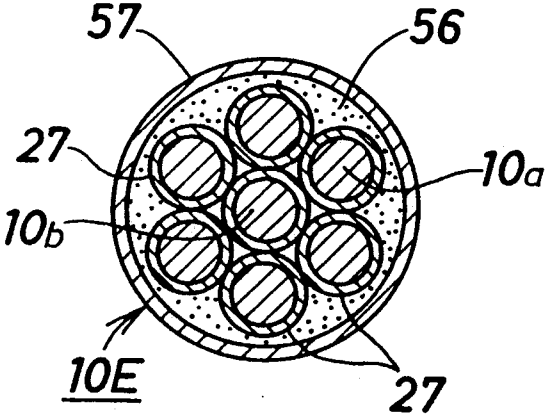
FIG. 15 is a similar view but showing a yet further corrosion resistant PC steel stranded cable to which the present invention is applied.
Figure 14:
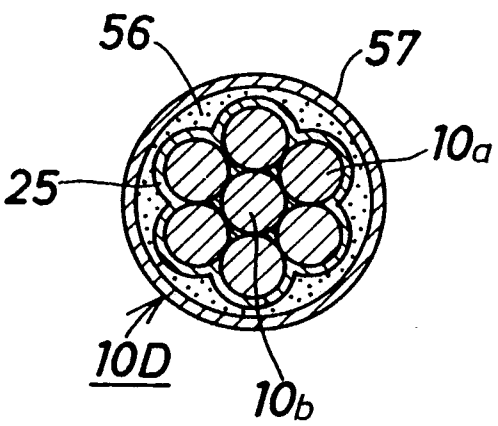
FIG. 14 is a cross sectional view of a still further corrosion resistant PC steel stranded cable to which the present invention is applied.

FIGS. 14 and 15 show still further corrosion resistant PC steel stranded cables to which the present invention is applied. The corrosion resistant PC steel stranded cables are constructed for corrosion resistant PC steel stranded cables for the posttensioning.

Referring first to FIG. 14, the corrosion resistant PC steel stranded cable 10D shown corresponds to a modification to the corrosion resistant PC steel stranded cable 10A described hereinabove in that a fatty substance 56 is applied to an outer face of the synthetic resin paint applying layer 25 on the outer periphery of the corrosion resistant PC steel stranded cable 10A and a coating tube 57 of a synthetic resin material is fitted around the fatty substance 56.

Meanwhile, the corrosion resistant PC steel stranded cable 10E shown in FIG. 15 corresponds to a modification to the corrosion resistant PC steel stranded cable 10B shown in FIG. 2 in that a fatty substance 56 is applied to an outer periphery of the synthetic resin paint coating layer 27 which covers the outer periphery of the corrosion resistant PC steel stranded cable 10B, that is, the side wires 10*a*, and a coating tube 57 of a synthetic resin material is fitted around the fatty substance 56 similarly as in the corrosion resistant PC steel stranded cable 10D.

Figure 16:
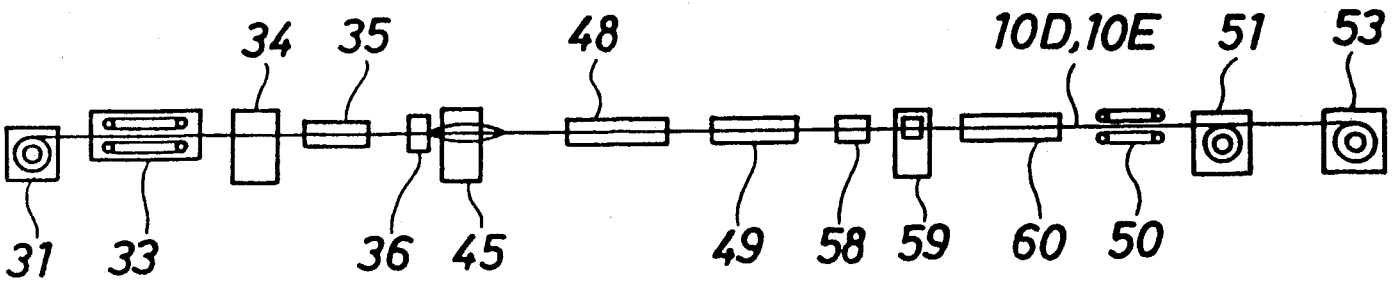
FIG. 16 PRIOR ART
FIG. 16 is a schematic view showing construction of a further apparatus for producing a corrosion resistant PC steel stranded cable to which the present invention is applied.
Figure 19:
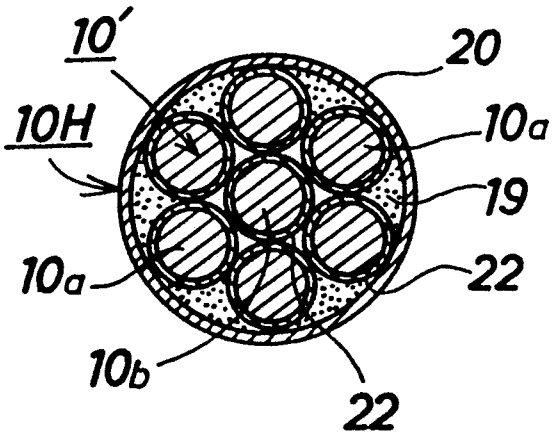
FIG. 19 PRIOR ART
FIGS. 17 to 21 are cross sectional views individually showing different conventional corrosion resistant PC steel stranded cables.
Figure 18:
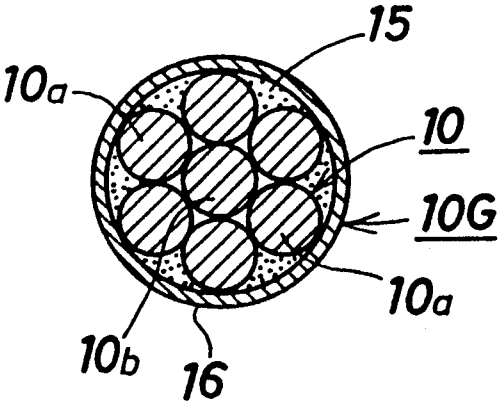
FIG. 18 PRIOR ART
Figure 17:
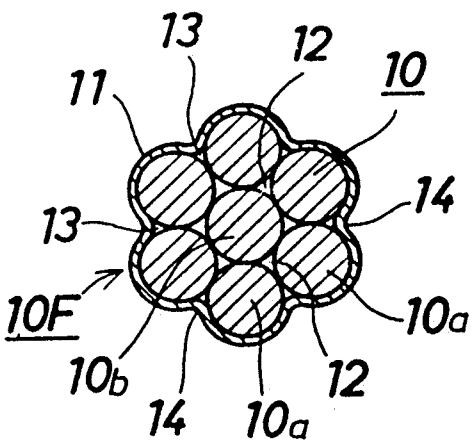
Figure 20:
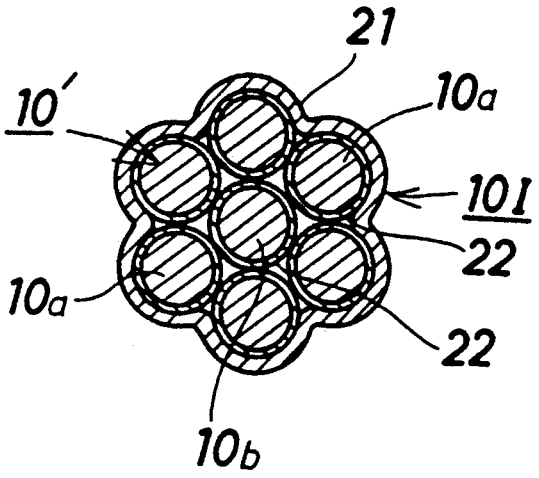
PRIOR ART FIG. 20
Figure 21:
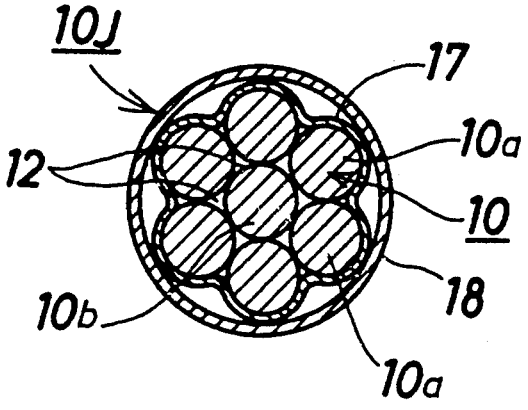
PRIOR ART FIG. 21

In producing the corrosion resistant PC steel stranded cables 10D and 10E, a producing apparatus shown in FIG. 16 is employed. The producing apparatus shown corresponds to a modification to the producing apparatus shown in FIG. 3 in that a fatty substance applying device 58, a protrusion molding machine 59 and a water or air cooling device 60 are disposed between the cooling device 49 and the drawing out device 50.

With the producing apparatus, the corrosion resistant PC steel stranded cable 10D or 10E can be produced such that the fatty substance 56 is applied, by the fatty substance applying device 58, to the outer periphery of the synthetic resin paint coating layer 25 or 27 formed similarly as in production of the corrosion resistant PC steel stranded cable 10A or 10B, and after then, the synthetic resin coating tube 57 is protruded to fit around the fatty substance 56 by the protrusion molding machine 59.

Having now fully described the invention, it will be apparent to one of ordinary skill in the art that many changes and modifications can be made thereto without departing from the spirit and scope of the invention as set forth herein.

What is claimed is:

1. A process of producing a corrosion resistant PC steel stranded cable from a bare PC steel stranded cable comprising a core wire and a plurality of side wires disposed in a closely contacting relationship with each other and with the core wire to define a plurality of spiral air gaps extending the length of the cable between said core wire and said side wires, said cable being adapted to be introduced into concrete, the process comprising the steps of:

preprocessing each of said core wire and said side wires with blueing to maintain a stabilized condition of said cable such that said cable has a twist habit in which said side wires and said core wire are inclined to maintain a twisted condition thereof, continuously untwisting the bare PC steel stranded cable over a predetermined length within a range within which the twist habit thereof is maintained, heating said bare PC steel stranded cable to a degree required to melt a synthetic resin paint material to be applied thereto, applying said synthetic resin paint material to the core wire and the side wires of an untwisted portion of the bare PC steel stranded cable to coat the core wire and the side wires individually with coatings of the synthetic resin paint material, and subsequently twisting the side wires around the core wire of the untwisted portion of the bare PC steel stranded cable, wherein a plurality of outwardly directed spiral recessed grooves are formed between adjacent ones of stranded side wires on outer surfaces of said stranded side wires for introducing a predetermined prestress to said concrete, said grooves extending in a longitudinal direction of said PC steel stranded cable.

2. A process of producing a corrosion resistant PC steel stranded cable as claimed in claim 1, wherein the synthetic resin paint material is formed, at the twisting step, as synthetic resin paint coating layers individually for the side wires and the core wire, said plurality of spiral air gaps extending the length of the cable being defined between the core wire and the side wires having said synthetic resin paint coating layers individually thereon, said plurality of spiral recessed grooves formed between adjacent ones of the stranded side wires having said synthetic resin paint coating layers individually thereon, on outer surfaces of said stranded side wires, said process further comprising a step of coating, after the twisting step, a second coating layer comprising a synthetic resin paint material in a closely contacting relationship on an outer periphery of the synthetic resin paint material coating layer on the side wires.

3. A process of producing a corrosion resistant PC steel stranded cable as claimed in claim 2, further comprising the steps of:

applying, after the twisting step, a fatty substance to an outer periphery of the synthetic resin paint coating layers on the side wires; and fitting a coating tube comprising a synthetic resin paint around the fatty substance by extrusion molding to coat the fatty substance with the coating tube.

4. A process of producing a corrosion resistant PC steel stranded cable as claimed in claim 1, further comprising the steps of:

applying, after the twisting step, a fatty substance to an outer periphery of the synthetic resin paint coating layer on the side wires, and fitting a coating tube comprising a synthetic resin paint around the fatty substance by extrusion molding to coat the fatty substance with the coating tube.

5. A process according to claim 1, further comprising conveying said bare PC steel stranded cable to a synthetic resin paint material applicator for applying said synthetic resin paint material to said bare PC steel stranded cable after said bare PC steel stranded cable has been heated to a degree required to melt said synthetic resin paint material.

6. An apparatus for producing a corrosion resisting PC steel stranded cable adapted to be introduced into concrete, comprising:

a supplying device for supplying therefrom a bare PC steel stranded cable in a twisted condition which comprises a core wire and a plurality of side wires disposed in a closely contacting relationship with each other and with the core wire to define sprial air gaps extending the length of the cable therebetween, each of the core wire and the side wires being pre-processed by blueing to maintain a stabilized condition of said cable such that said cable has a twist habit in which said side wires and said core wire are inclined to maintain a twisted condition thereof;

an untwisting device for continuously untwisting the bare PC steel stranded cable supplied from said supplying device over a predetermined length within a range within which the twist habit thereof is maintained;

means for heating said bare PC steel stranded cable;

a first powder paint applying device for applying a synthetic resin paint material to the core wire and the side wires of the untwisted portion of the predetermined length of the bare PC steel stranded cable to coat the core wire and the side wires with the synthetic resin paint material to obtain a corrosion resisting PC steel stranded cable, said synthetic resin paint material being applied to said bare PC steel stranded cable after said bare PC steel stranded cable has been heated by said heating means to a degree required to melt said synthetic resin paint material applied to said bare PC steel stranded cable, wherein said corrosion resisting PC steel stranded cable has a plurality of outwardly directed spiral recessed grooves formed between adjacent ones of the side wires having been coated with said synthetic resin paint material, said grooves being for introducing a predetermined prestress to said concrete, said grooves extending in a longitudinal direction of said PC steel stranded cable, and the corrosion resisting PC steel stranded cable being automatically restored to the twisted condition of the bare PC steel stranded cable after being fed out from said first powder paint applying device; and a take-up device for winding thereon the corrosion resistant PC steel stranded cable having been restored to the twisted condition.

7. An apparatus for producing a corrosion resisting PC steel stranded cable as claimed in claim 6, further comprising a second powder paint applying device interposed between said first powder paint applying device and said take-up device for applying a synthetic resin paint material to an outer periphery of the synthetic resin paint of the corrosion resisting PC steel stranded cable after the corrosion resisting PC steel stranded cable is restored to the twisted condition.

8. An apparatus for producing a corrosion resisting PC steel stranded cable as claimed in claim 6, further comprising:

a fatty substance applying device for applying a fatty substance to an outer periphery of the corrosion resisting PC steel stranded cable after the corrosion resisting PC steel stranded cable is restored to the twisted condition, and a protrusion molding machine for fitting a coating tube comprising a synthetic resin paint material around an outer periphery of the fatty substance applied to the corrosion resisting PC steel stranded cable to coat the corrosion resisting PC steel stranded cable.

9. An apparatus according to claim 6, further comprising means for conveying said bare PC steel stranded cable having been heated to a degree required to melt said synthetic resin paint material to be applied thereto to said first powder paint applying device for applying said synthetic resin paint material to said bare PC steel stranded cable.

* * * * *